US007582023B2

(12) United States Patent
Hung

(10) Patent No.: US 7,582,023 B2
(45) Date of Patent: Sep. 1, 2009

(54) CONNECTING STRUCTURE OF A SHAFT AND A GRIP MEMBER OF A GOLF CLUB

(75) Inventor: Chi-Chih Hung, Feng-Shan (TW)

(73) Assignee: Eing Nan Rubber Co., Ltd., Kaohsiung Hsien (TW)

( * ) Notice: Subject to any disclaimer, the term of this patent is extended or adjusted under 35 U.S.C. 154(b) by 42 days.

(21) Appl. No.: 12/003,087

(22) Filed: Dec. 20, 2007

(65) Prior Publication Data

US 2009/0163286 A1 Jun. 25, 2009

(51) Int. Cl.
*A63B 53/14* (2006.01)

(52) U.S. Cl. ..... 473/299; 473/300; 411/55

(58) Field of Classification Search ..... 473/300–303, 473/295, 297, 298, 299; 411/55
See application file for complete search history.

(56) References Cited

U.S. PATENT DOCUMENTS

| | | | | | |
|---|---|---|---|---|---|
| 626,633 | A * | 6/1899 | Robinson | 74/551.9 |
| 1,580,724 | A * | 4/1926 | Harmon | 74/551.9 |
| 2,225,839 | A * | 12/1940 | Moore, Jr. | 473/295 |
| 3,245,686 | A * | 4/1966 | Hartmeister | 473/203 |
| 4,259,890 | A * | 4/1981 | Walsh | 411/80.2 |
| 4,564,324 | A * | 1/1986 | Leibhard | 411/3 |
| 4,826,168 | A * | 5/1989 | McGuire et al. | 473/295 |
| 5,431,516 | A * | 7/1995 | Haage et al. | 411/55 |
| 5,746,556 | A * | 5/1998 | Sato | 411/42 |
| 6,074,119 | A * | 6/2000 | Schlanger | 403/297 |
| 6,196,778 | B1 * | 3/2001 | Wakai | 411/42 |
| 6,533,301 | B1 * | 3/2003 | Catania | 280/124.13 |
| 6,739,813 | B1 * | 5/2004 | Gundy et al. | 411/60.2 |
| 7,261,641 | B2 * | 8/2007 | Lindner | 473/297 |
| 7,481,716 | B1 * | 1/2009 | Johnson | 473/297 |
| 2009/0062031 | A1 * | 3/2009 | Holtzman | 473/307 |

* cited by examiner

*Primary Examiner*—Stephen L. Blau
(74) *Attorney, Agent, or Firm*—Rosenberg, Klein & Lee

(57) ABSTRACT

A golf club includes a shaft, a grip member positioned around a tail portion of the shaft, an expanding component positioned in the tail portion of the shaft, and a fastening component; the grip member has a holding room to receive the tail portion of shaft; the expanding component is made of rubber, and has an axial central hole, and a rugged. outer side; the fastening component has a head part, which has a greater diameter than the central hole of the expanding component; the fastening component has threads thereon; the fastening component is inserted in the axial hole of the expanding component, with the head part being pressed against the grip member so that the rugged outer side of the expanding component is tightly pressed against the inner side of the tail portion of the shaft, and the grip member and the shaft are fastened together.

4 Claims, 4 Drawing Sheets

CONNECTING STRUCTURE OF A SHAFT AND A GRIP MEMBER OF A GOLF CLUB

BACKGROUND OF THE INVENTION

1. Field of the invention

The present invention relates to a connecting structure of a shaft and a grip member of a golf club, more particularly one, which enables the shaft and the grip member to be firmly coupled together without the possibility of one turning relative to the other to reduce the accuracy of the flying direction of a golf ball when the golf club hits against the golf ball.

2. Brief Description of the Prior Art

A common golf club has a grip member secured around a tail portion of the shaft, which is easy to hold, and will absorb the shock against the golfer's hands when the golf club hits against a golf ball.

U.S. Pat. No. 6,626,768 teaches a golf club structure, wherein a grip member is directly placed around a shaft without any fastening means to prevent both from turning relative to each other. Therefore, it is possible for the shaft to turn relative to the grip member to reduce the accuracy of the flying direction of a golf ball when the golf club hits against the golf ball.

U.S. Pat. No. 6,988,958 taught another golf club structure, wherein a metallic ring is buried in a grip member, and the grip member is positioned around and fastened to a shaft with a bolt being passed through a hole of the grip member and a hole of the metallic, and tightly pressed against the shaft to prevent the shaft from turning relative to the grip member. However, because both and the shaft and the bolt are made of metallic materials, and the tail end of the bolt and the shaft have a smooth surface, it is still possible for the shaft to turn relative to the grip member when the golf club hits against a golf ball.

SUMMARY OF THE INVENTION

It is a main object of the present invention to provide an improvement on a connecting structure of a shaft and a grip member of a golf club, which will prevent the shaft from turning relative to the grip member to reduce the accuracy of the flying direction of a golf ball when the golf club hits against the golf ball.

A golf club according to an embodiment of the present invention includes a shaft, a grip member positioned around a tail portion of the shaft, an expanding component positioned in the tail portion of the shaft, and a fastening component. The grip member has a holding room to receive the tail portion of shaft. The expanding component is made of rubber, and has an axial central hole, and a rugged outer side. The fastening component has a head part, and screw threads, and is inserted in the axial hole of the expanding component, with the head part being pressed against the grip member; thus, the rugged outer side of the expanding component is expanded, and tightly pressed against the inner side of the tail portion of the shaft, and in turn the grip member and the shaft are fastened together.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
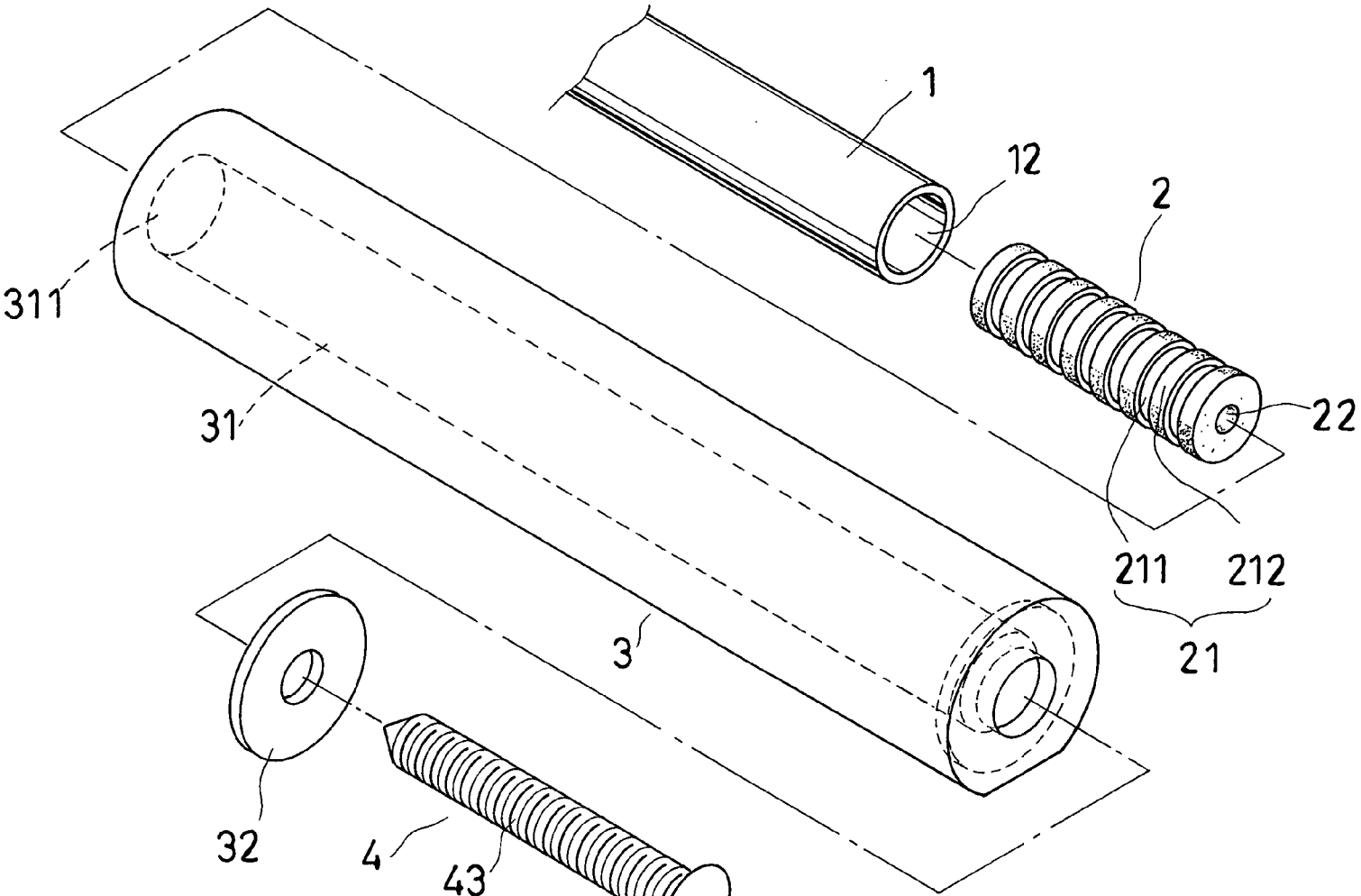
FIG. 1 is an exploded perspective view of the present invention.

Referring to FIG. 1, a preferred embodiment of a golf club of the present invention includes a shaft 1, an expanding component 2, a grip member 3, and a fastening component 4.

The shaft 1 has an inner hollowness 11, and an opening 12 on a tail portion thereof, which is in open communication with the inner hollowness 11.

The expanding component 2 is made of soft plastic materials or rubber materials, and positioned in the tail portion of the shaft 1. The expanding component 2 has several spaced apart annular raised portions 212 and depressions 211 on an outer surrounding side 21 thereof; the annular raised portions 212 exist between the depressions 211, and the depressions 211 exist between the annular raised portions 212. The expanding component 2 has a central hole 22 extending in an axial direction thereof.

The grip member 3 is positioned around the tail portion of the shaft 1. The grip member 3 has a holding room 31 therein to hold the tail portion of the shaft 1; the holding room 31 has an opening 311 facing the shaft 1 for the tail portion of the shaft 1 to pass through.

The fastening component 4 is inserted in the central hole 22 of the expanding component 2. The fastening component 4 has a head part 42 and a rod part 41 with a threaded portion 43. The rod part 41 of the fastening component 4 has a greater diameter than the central hole 22 of the expanding component 2. And, the diameter of the head part 42 is greater than the diameter of the holding room 31 of the grip member 3.

Figure 2:
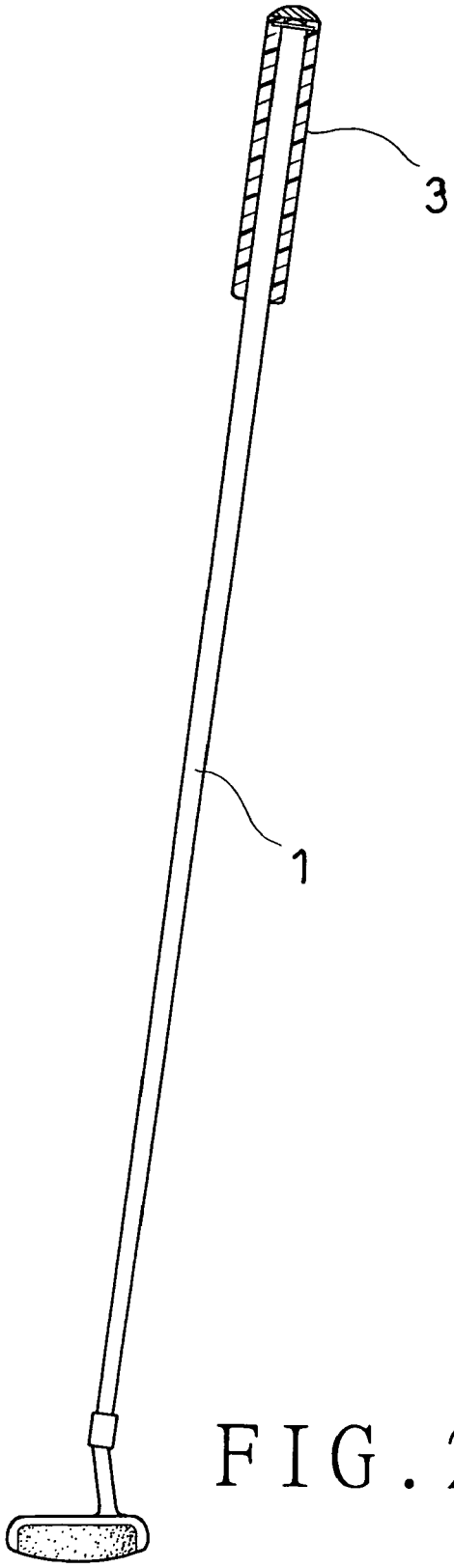
FIG. 2 is a sectional view of the present invention.
Figure 5:
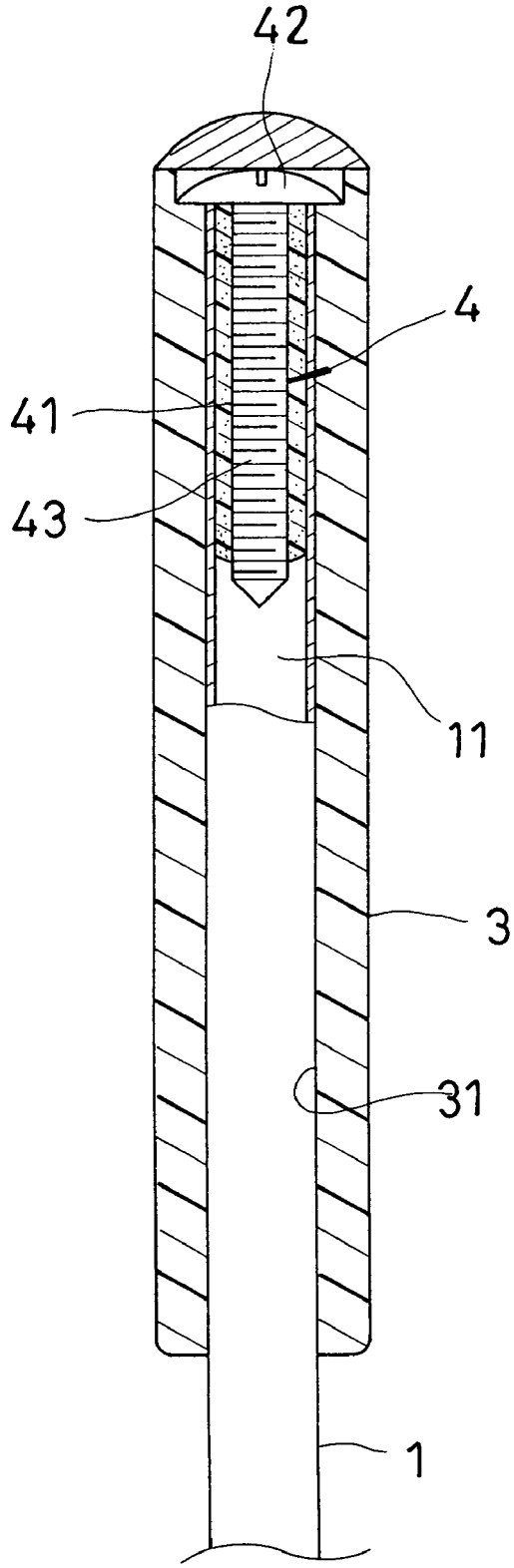
FIG. 5 is an enlarged sectional view of another embodiment.

In assembly, referring to. FIGS. 1, 2, and 5, first the expanding component 2 is positioned into the inner hollowness 11 of the shaft 1 through the opening 12, and the shaft 1 is passed into the holding room 31 of the grip member 3 from the tail portion thereof. Then, the fastening component 4 is inserted into the central hole 22 of the expanding component 2, with the head part 42 of the fastening component 4 being tightly pressed against the grip member 3; the depressions 211 and the annular raised portions 212 of the expanding component 2 will expand and change shape, and in turn the rugged outer surrounding side 21 will be tightly pressed against the inner side of the tail portion of the shaft 1 because the expanding component 2 is made of rubber materials, and because the rod part 41 of the fastening component 4 has a greater diameter than the central hole 22 of the expanding component 2. Thus, the grip member 3 and the shaft 1 are fastened together.

The expanding component 2 will return to its original size, and no longer be tightly pressed against the inner side of the tail portion of the shaft 1 as soon as the fastening component 4 is loosened, and separated from the expanding component 2; thus, the grip member 3 can be separated from the shaft 1. Therefore, it is relatively easy to replace the grip member 3 with a new one.

Figure 3:
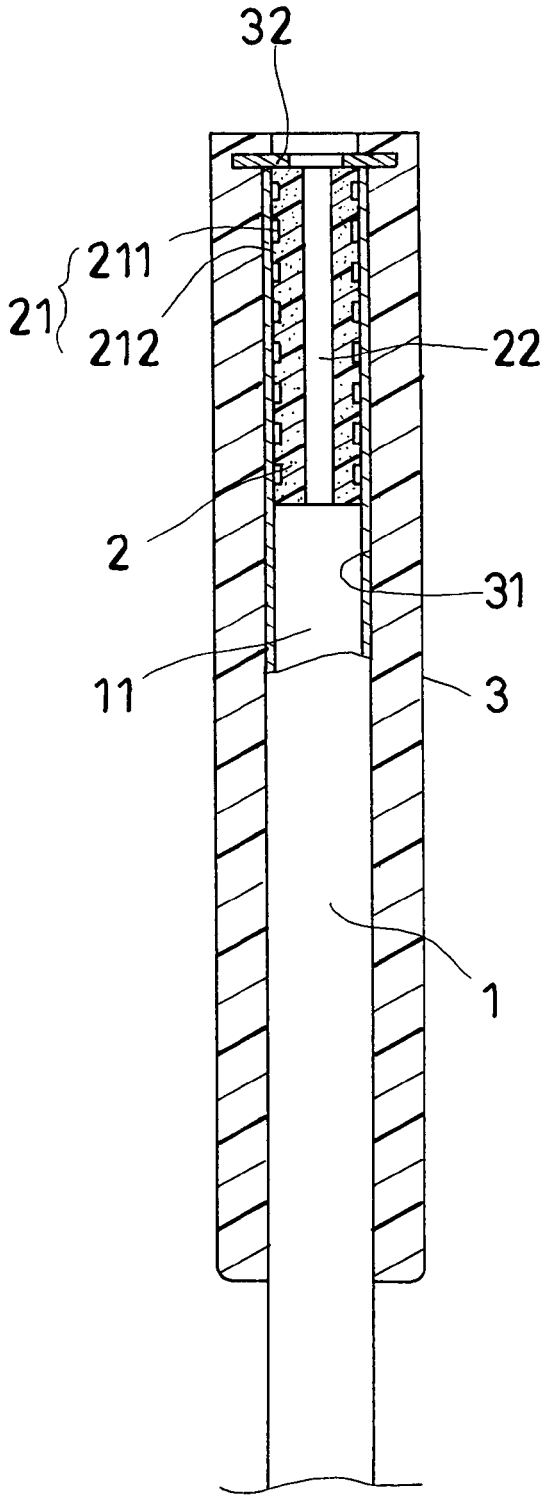
FIG. 3 is an enlarged sectional view of the present invention, taken before the fastening component is passed into the shaft.
Figure 4:
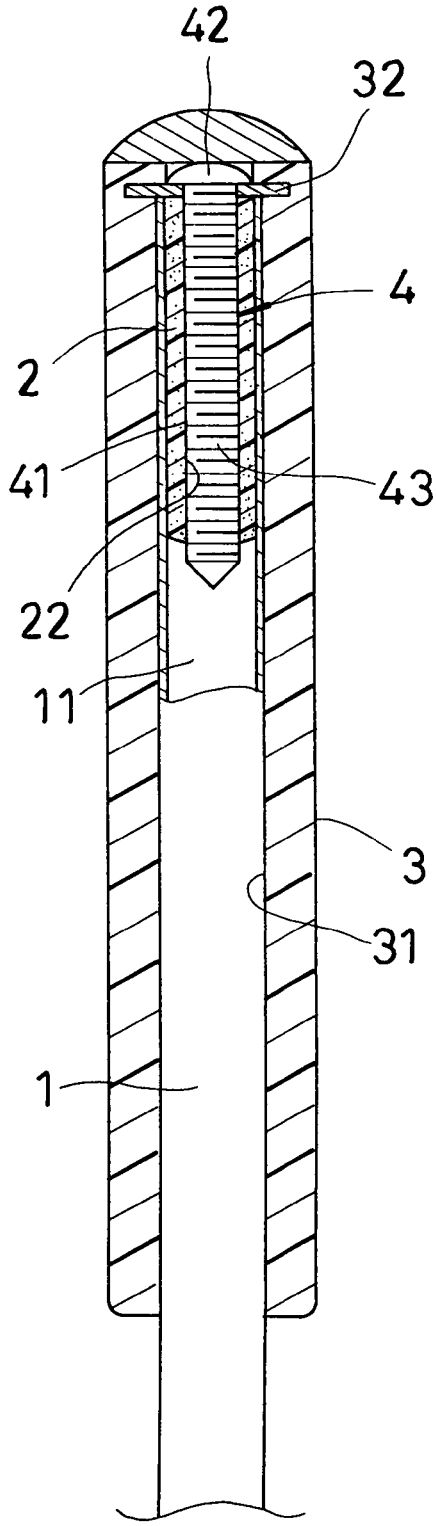
FIG. 4 is an enlarged sectional view of the present invention, taken after the fastening component is passed into the shaft.

Furthermore, a metallic strengthening element 32 is buried in a tail end of the grip member 3 to increase the strength of the tail end of the grip member 3, as shown in FIGS. 3 and 4; thus, there will be much less risk of the grip member 3 getting damaged when the grip member 3 is subjected to external force in use/while the fastening component 4 is passed into the expanding component 2.

From the above description, it can be seen that the golf club structure of the present invention has the following advantages:

The golf club is relatively easy to assemble; the grip member is securely joined to the shaft of the golf club with the expanding component being expanded by means of the fastening component in order for the rugged outer surrounding side to be tightly pressed against the inner side of the shaft, and with the head part of the fastening component being tightly pressed against the grip member.

The expanding component will no longer be tightly pressed against the inner side of the tail portion of the shaft, and in turn the grip member can be separated from the shaft as soon as the fastening component is separated from the expanding component. Therefore, the grip member can be replaced with a new one very easily.

What is claimed is:

1. A connecting structure of a shaft and a grip member of a golf club, comprising a shaft, the shaft having an opening on a tail portion thereof;

an expanding component positioned in the tail portion of the shaft, the expanding component having a rugged outer surrounding side; the expanding component having a central hole extending in an axial direction thereof;

a grip member positioned around the tail portion of the shaft, the grip member having a holding room to hold the tail portion of the shaft; the holding room of the grip member having an opening facing the shaft; and a fastening component inserted in the central hole of the expanding component, the fastening component having a head part and a rod part with a threaded portion; the rod part of the fastening component having a greater diameter than the central hole of the expanding component; a diameter of the head part of the fastening component being greater than a diameter of the holding room of the grip member.

2. The connecting structure of a shaft and a grip member of a golf club as claimed in claim 1, wherein the expanding component is made of rubber materials.

3. The connecting structure of a shaft and a grip member of a golf club as claimed in claim 1, wherein the rugged outer surrounding side of the expanding component has a plurality of raised portions and depressions thereon, which extend in a radial direction of the enlarging component.

4. The connecting structure of a shaft and a grip member of a golf club as claimed in claim 3, wherein the rugged outer surrounding side of the expanding component includes a plurality of annular raised portions, and a plurality of depressions; the annular raised portions of the expanding component existing between the depressions; the depressions existing between the annular raised portions.

* * * * *